US005330351A

United States Patent [19]

Ransom, Jr. et al.

[11] Patent Number: 5,330,351

[45] Date of Patent: Jul. 19, 1994

[54] TREFOIL CONSTRUCTION FOR ROTARY KILNS

[75] Inventors: George E. Ransom, Jr., Wayne; George E. Ransom, III, Saddle Brook, both of N.J.; Ralph Ingerson, Jr., Bel Air, Md.

[73] Assignee: RRI, Inc., Paterson, N.J.

[21] Appl. No.: 102,919

[22] Filed: Aug. 6, 1993

[51] Int. Cl.[5] ..... F27B 7/28

[52] U.S. Cl. ..... 432/103; 432/118; 432/119

[58] Field of Search ..... 432/103, 105, 106, 110, 432/111, 114, 118, 119

[56] References Cited

U.S. PATENT DOCUMENTS

| | | | |
|---|---|---|---|
| 3,030,091 | 4/1962 | Wicker et al. | 432/119 |
| 3,175,815 | 3/1965 | Wicker et al. | 432/119 |
| 4,340,360 | 7/1982 | Hoedl et al. | 432/118 |

*Primary Examiner*—Henry C. Yuen
*Attorney, Agent, or Firm*—Siegmar Silber

[57] ABSTRACT

The invention discloses a multichambered structure for a rotary kiln.

At least three bases are formed from radial blocks equidistantly spaced about and adjustably attached at one surface thereof to the inner surface of the steel shell, each base extending axially along the steel shell and on the surface opposite the attachment having a profile therein for accepting spoke blocks. The chamber walls are formed from spoke blocks with each of the walls extending radially from one of the bases and axially along the length of the base to the center portion of the cylindrical body. The spoke blocks are specially configured with one side thereof having a profile complementary to the radial blocks for mating therewithin and the side opposite thereof a profile for accepting additional ones of the spoke bricks. Additionally, a hub assembly formed from specially configured hub segments interlocks with the spoke bricks of the three walls and extends axially along the centralmost portion of the walls. Each spoke block has an offset profile and forms a wall resistant to torsional forces resulting from the flow of the charge during the rotation of the kiln.

20 Claims, 6 Drawing Sheets

TREFOIL CONSTRUCTION FOR ROTARY KILNS

BACKGROUND OF THE INVENTION

1. Field of the Invention

This invention relates to a multichambered heat exchanger structure for a rotary kiln and, more particularly, to a rotary kiln for lime and cement processing which operates at high temperatures. Each of these rotary kilns is a long, slightly inclined cylinder with a charge of limestone or product-to-be-treated introduced at the higher end and heated air flowing countercurrent thereto introduced at the lower end. The structure, which has a refractory brick interior and a steel shell exterior, has the heat exchanger medial the ends thereof. The heat exchanger splits the flowing charge for improved surface contact into multiple flows. The kiln structure is sufficiently large that the steel shell deflects and the heat exchanger hereof is constructed to resist both the shell deflection and the kiln operating forces.

2. Information Disclosure Statement

Rotary kilns have a long and interesting technological history with, what is believed to be the earliest rotary kiln patented in England in 1885. This rotary kiln, called the Ransome kiln, was mounted at a slight angle and lined with fireclay brick. The kiln was charged at the higher end and fired at the lower end.

In the past, rotary kilns have been equipped with heat exchanger structures sometimes called trefoils manufactured by Harbison-Walker Refractories, Inc., now a division of Dresser Industries, Inc. and other refractory companies. As seen in the three Wicken et al. patents, infra, the trefoil structure shown have dam arrangements or interconnected trefoil lobes. In the Wicken et al. specifications, the refractory bricks are described as having, "conventional complementing tongues and grooves to afford some degree of mechanical interlock." This teaches away from the structure described hereinbelow.

Although some devices for adjusting refractory block positions with respect to the kiln interior wall, such as Antill '971, infra, are known, each is distinguishable from this disclosure.

In preparing for this application, the following U.S. patents became known to the inventor hereof:

| ITEM NO. | U.S. PAT. NO. | INVENTOR | ISSUE DATE |
|---|---|---|---|
| 1. | 1,431,530 | C. H. Leicester | 10/10/22 |
| 2. | 1,534,475 | A. H. Willett et al | 04/21/25 |
| 3. | 1,741,680 | G. W. Davey | 12/31/29 |
| 4. | 2,341,971 | P. W. Antill | 02/15/44 |
| 5. | 3,030,091 | O. M. Wicken et al | 04/17/62 |
| 6. | 3,036,822 | N. E. Anderson | 05/29/62 |
| 7. | 3,169,016 | O. M. Wicken et al | 02/09/65 |
| 8. | 3,175,815 | O. M. Wicken et al | 03/30/65 |
| 9. | 3,221,614 | J. Pertien | 12/07/65 |
| 10. | 3,346,248 | J. R. Martinet et al | 10/10/67 |
| 11. | 3,362,698 | J. J. Cerny et al | 01/09/68 |
| 12. | 3,834,108 | H. T. Ludvigsen | 09/10/74 |
| 13. | 4,543,893 | M. Kunnecke | 10/01/85 |
| 14. | 4,846,677 | R. J. Crivelli | 07/11/89 |
| 15. | 4,960,058 | W. R. Materna | 10/02/90 |
| 16. | 4,975,049 | H. L. Roenigk et al | 12/04/90 |

These became known to the inventor by the review of Class 432, Subclasses 118 and 119; Class 110, Subclass 338; and, Class 52, Subclasses 604, 605, and 608.

U.S. Pat. No. 1,431,530 - C. H. Lucister - Issued Oct. 10, 1922

Discloses interlocking brick for constructing walls and furnaces having in one plane alternating keys and recesses that can be arranged in half brick staggered interlocking manner.

U.S. Pat. No. 1,534,475 - A. H. Willett et al. - Issued Apr. 21, 1925

Discloses fire brick for sectional fire arches on locomotives. The bricks have a tongue and groove arrangement interlocking with one another and permit a directed flow of gases which maintains the combustion in the furnace.

U.S. Pat. No. 1,741,680 - G. W. Davey - Issued Dec. 31, 1929

Discloses furnace wall construction from slidably interlockable components which provide air cooled chambers adjacent the outer wall to keep the wall at a temperature below softening point.

U.S. Pat. No. 2,341,971 - P. W. Antill - Issued Feb. 15, 1944

Discloses a furnace wall sectionally supported by hanger castings forming an air-cooled, tied wall. The wall accepts bats of insulating material between supporting refractory blocks.

U.S. Pat. No. 3,030,091 - O. M. Witken et al - Issued Apr. 17, 1962

Discloses a rotary kiln with a trefoil heat exchanger with each section having at the downstream end a dam to prevent sifting of the material when the section is uppermost.

U.S. Pat. No. 3,036,822 - N. E. Anderson - Issued May 29, 1962

Discloses a rotary kiln with a partitioned section dividing the stream into six equal streams. The partitions are mounted to yokes exterior to the kiln shell which compensate for kiln deformation.

U.S. Pat. No. 3,169,016 and U.S. Pat. No. 3,175,815 - O. M. Wicken et al - Issued Feb. 9, 1965 and Mar. 30, 1965, respectively.

Discloses rotary kilns with trefoil heat exchangers. The trefoil spokes are apertured allowing material to be dropped through into the countercurrent flowing gases of the adjacent chamber.

U.S. Pat. No. 3,221,614 - J. Pertien - Issued Dec. 7, 1965

Discloses a keyed road paving block preventing transverse and longitudinal movement in response to traffic.

U.S. Pat. No. 3,346,248 - J. R. Martinet et al - Issued Oct. 10, 1967

Discloses a wedge-shaped, refractory block structure for rotary kilns. The blocks have recesses and protuberances that interlock and expansion or spacer plates thereon, which structures tolerate temperatures to 1,000° F. without decomposing.

U.S. Pat. No. 3,362,698 - J. J. Cerny et al - Issued Jan. 9, 1968

Discloses a refractory lining structure for a rotary kiln. Interlocking bricks interlock with each other and with brick holders mounted on the kiln shell. Insulation is inserted between the shell and the refractory bricks.

U.S. Pat. No. 3,834,108 - H. J. Ludvigsen - Issued Sep. 10, 1974

Discloses a building element for walls with one side providing a regular brick pattern and the other providing an interlocking arrangement.

U.S. Pat. No. 4,543,897 - M. Kunnecke - Issued Oct. 1, 1985

Discloses a lining brick for a rotary kiln with an air space for insulating the shell and for retaining heat in the kiln.

U.S. Pat. No. 4,846,677 - R. J. Crivelli - Issued Jul. 11, 1989

Discloses a trefoil heat exchanger for a rotary kiln with buttressed axial end portions of poured-in-place castable refractory to prevent downhill sliding of the trefoil construction.

U.S. Pat. No. 4,960,058 - W. R. Materna - Issued Oct. 2, 1990

Discloses a self-positioning refractory structure similar in interlocking relationship to Cerny et al. '698, supra. The structure has positioning filler and wedge refractories defining the annular space about the kiln.

U.S. Pat. No. 4,975,049 - Roenigk et l - Issued Dec. 4, 1990

Discloses refractory block for nose ring of a rotary kiln. Each block has lateral and rotational adjustments that are self-aligning.

None of the known patents address the technical problems of structuring trefoils to withstand both the compressive and torsional forces as is addressed hereby.

SUMMARY

A heat exchanger structure for a rotary kiln is disclosed. The multichambered structure is uniquely assembled from a few types of interlocking precast blocks. For the purpose of this application, an ultra high-strength castable refractory is one having a high hot modulus of rupture. Blocks constructed therefrom resist kiln operating forces that are specific to rotary kilns. The kiln, because of its size and loading, while rotating, has deflections along the steel shell thereof which deflections create compressive forces upon a heat exchanger structure. Additionally, torsional forces are imposed upon the heat exchanger structure by the inflowing charge during the rotation of the kiln. Four basic blocks have been precast from refractory material, namely, a radial block, a spoke block, a hub block, and a retention support block. The radial blocks, which form bases equidistantly spaced about the shell, are adjustably attached to the inner surface of the steel shell by adjustable leveling assemblies. The spoke blocks form the heat exchanger chamber walls and each wall extends radially from a base to a central hub. The kiln and the hub are coaxial. The spoke blocks have one side with a profile complementary to the radial blocks for mating therewithin and have on the side opposite a profile for accepting additional spoke blocks. The spoke blocks may be emplaced in either an abutting arrangement or a lap bond arrangement. In the lap bond arrangement, the blocks are designed to interlock in the direction of the longitudinal axis of the kiln. The hub segments interlock with one another and with the spoke blocks of the walls to form an interlocked hub extending axially along and joining adjacent walls. As an adjustment for deformations in the steel shell, an adjustment device is inserted between the steel shell and radial blocks. This enables the heat exchanger structure to be installed true to the longitudinal axis regardless of any irregularities that may exist in the steel shell. Any annular space left is then filled with a high strength refractory to maintain the position of the radial blocks.

OBJECT AND FEATURES OF THE INVENTION

It is an object of the present invention to provide a heat exchanger structure for a rotary kiln which economically employs pre-cast refractory structural elements and is readily installed.

It is a further object of the present invention to provide a heat exchanger structure which, by means of a buttressing refractory, and the shapes of the individual pieces, resists axial movement in the direction of product flow.

It is yet another object of the present invention to provide a heat exchanger structure which, by means of interlocking structural components, resists twisting movement in response to the flexion of the shell of the rotating kiln.

It is still yet another object of the present invention to provide a heat exchanger mount for positioning the structure in a manner which compensates for the out-of--roundness of the kiln resulting from repairs or damage to the steel shell.

It is a feature of the present invention that the heat exchanger structure is formed from a minimum of differently shaped pre-cast refractory structural elements.

It is another feature of the present invention to have an installation of the heat exchanger structure serve to prevent the spiralling of the adjacent refractory brick lining of the rotary kiln.

It is yet another feature of the present invention to have an installation of the heat exchanger structure which reduces the effect thereon from the flexion of the shell during operation of the rotary kiln.

Other objects and features of the invention will become apparent upon review of the drawings and the detailed description.

In the following drawings, the same parts in the various views are afforded the same reference designators.

DESCRIPTION OF THE PREFERRED EMBODIMENT

The rotary kiln structure of this invention may be viewed as a long slightly inclined cylinder with a charge to be treated and introduced at the higher end or rear and heated air flowing countercurrent thereto introduced at the lower end or front. The structure has a refractory brick interior and a steel shell exterior. The structure is sufficiently large that the steel shell deflects by flexure and/or sagging. The kiln tends to sag between support trunions and the uppermost portion flattens somewhat, and the sides responsively are bowed outwardly. Thus, the cross-section is irregularly out-of-round and every point in shell rotates through this deformed circular pathway. When lining bricks are emplaced, the out-of-roundness does not remarkably impact the bricks as each one acts as though mounted on a radial line and the deflection tends to vibrate the brick back and forth along the radius.

A heat exchanger, namely a three-chambered section (known as a trefoil) or other multichambered structure, has a more complicated relationship to the shell flexure. Here, in the trefoil example, a circular structure with a hub and three spokes is erected within the deformed circle. The dilemma is that, if the outer circle of the trefoil attempts to reverse the deformation of the shell, large compressive forces are exerted in a wavelike manner upon the trefoil as the shell wants to assume its shape of least resistance. On the other hand, if the outer circle of the trefoil attempts to be inscribed within the deformed circle and evade the deformation issue, the trefoil is harder to stabilize axially and forms a "loose canon" which may be twisted in its mounting by the torsional forces exerted by the dividing and rolling of the charge during kiln rotation.

The technological problem is resolved in two ways, namely, by a unique trefoil mounting and by unique trefoil subcomponents. The trefoil mounting arrangement, as will be seen in the further explication in the text which follows, enables the trefoil to be properly positioned within the steel shell. Downstream axial movement of the trefoil structure is managed in several ways. Further, the irregular space between the shell and the circular trefoil structure is spanned by adjustment devices and is then filled with a high strength refractory material. This relieves some of the compressive and torsional forces and combines with the trefoil subcomponent design which retains some radial mobility.

Figure 1:
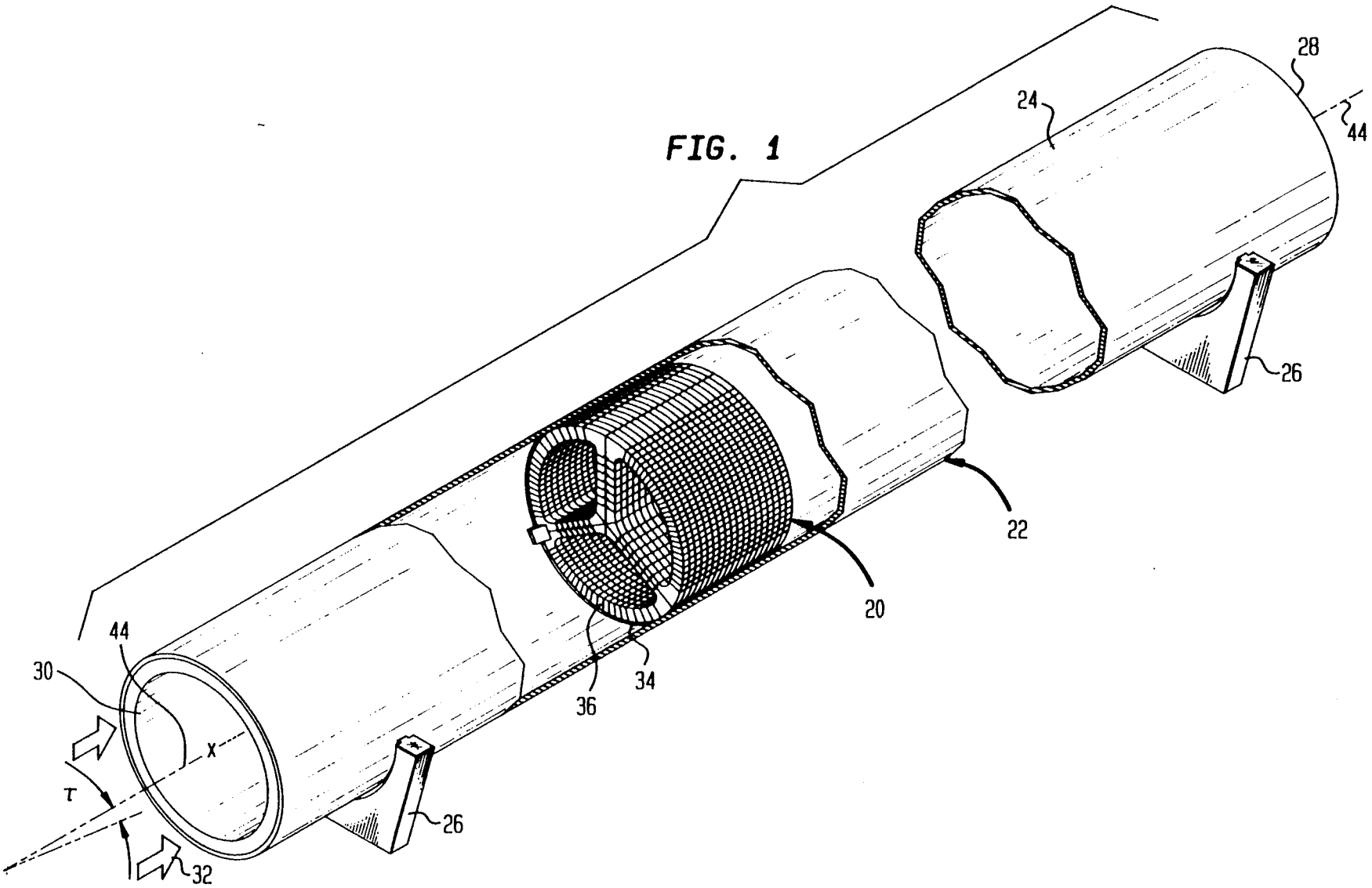
FIG. 1 is a perspective plan view of a rotary kiln having therein a three-chamber heat exchanger construction of the present invention, the rotary kiln being shown with a portion of the exterior shell and refractory lining broken away.

The trefoil of this invention is shown in FIG. 1 in relation to the rotary kiln in which the trefoil is installed. The trefoil or multichambered structure is referred to generally by the numeral 20 and the rotary kiln by the numeral 22. In the description, which follows, a three-chambered structure is detailed; however, the same technology is applicable to a greater number of chambers. The steel shell 24 is shown broken away so that the trefoil 20 is fully shown. Usually, kilns used for cement or lime applications can be 100 to 650 feet in length and 3 to 25 feet in diameter. The trefoil 20 occupies a longitudinal section medial the kiln. For and by way of example, in such an application, the section is typically 12 feet in length. A kiln may contain more than one heat exchanger section. The kiln 22 is mounted for rotation on trunions 26 with the influent end 28 elevated so that a charge of materials-to-be-processed can flow by gravity downstream within the rotating kiln as it rotates. The kiln 22 at the effluent end 30 discharges the dried and/or calcined materials. Here, heated air and gaseous products of combustion, indicated by arrows 32, are introduced and flow in a countercurrent direction to the materials being processed. In a kiln, the chamber temperature may be anywhere between a low temperature of 1000° F. to a high of 3,000° F. Because the heat exchanger structure is subjected to extremely high torsional forces from the flowing materials charged, various means of construction are used to minimize the effect thereof. In preparation, downstream of the trefoil 20, a retainer ring 34 is constructed and is secured adjacent the standard shaped refractory usually referred to as rotary kiln brick lining 36. Standard shaped refractory brick lining 36 installed upstream from the retaining ring 34 is usually constructed of prefired standard refractory shapes. The standard refractory brick shapes 36 are also installed in the heat exchanger area between the radial blocks of the heat exchanger legs and immediately upstream thereof. A retention support block as described below is placed against the radial blocks to support them and keep the structure 20 from moving down the kiln.

Figure 2:
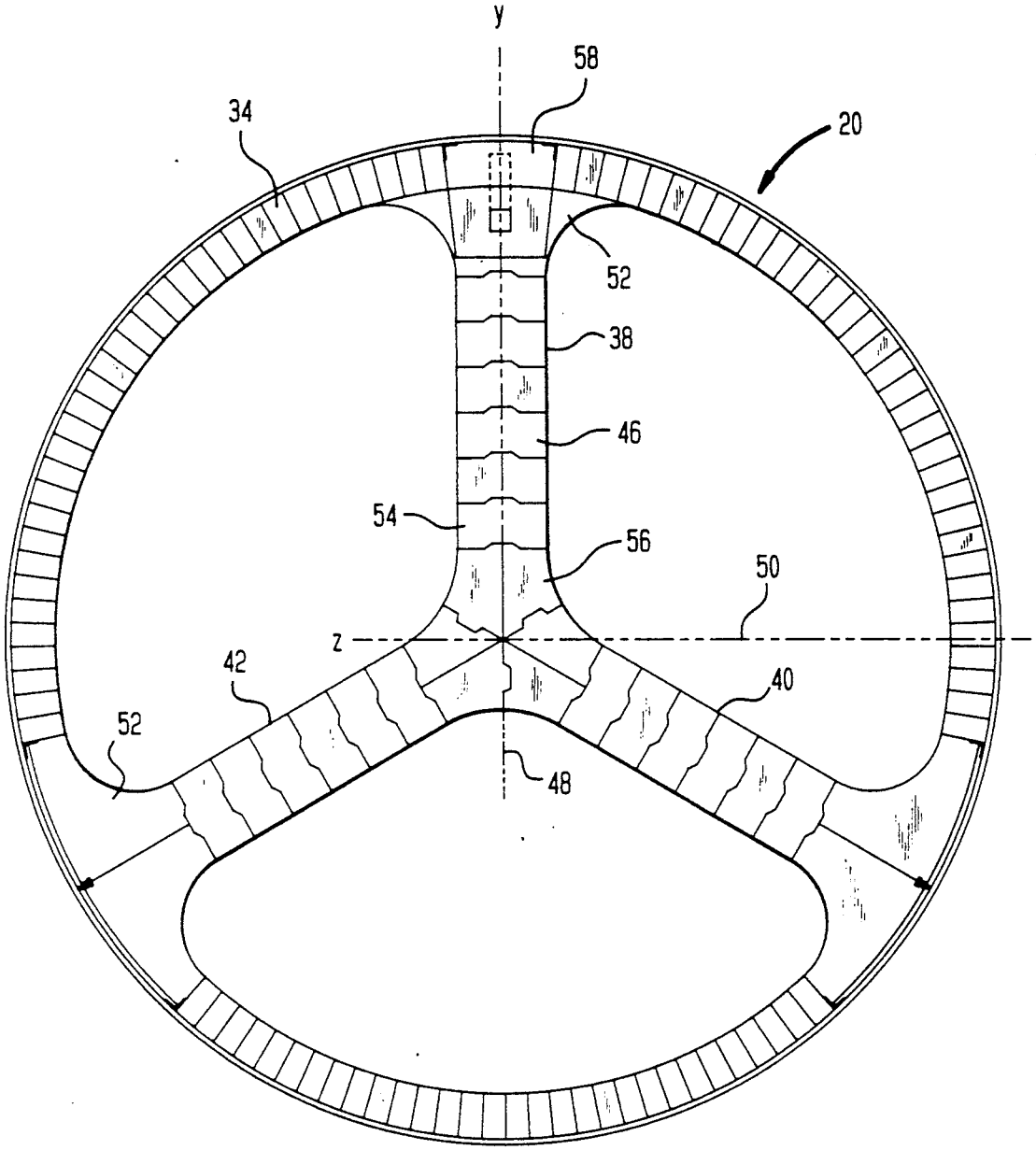
FIG. 2 is an end elevational view of the invention shown in FIG. 1 with the kiln rotated to position the axis of one spoke of the three-chamber heat exchanger construction in a substantially vertical position.

Referring now to FIG. 2, an end view of a three-chambered heat exchanger known as a trefoil 20 construct is shown and has three spokes or walls 38, 40 and 42 radiating from the center of the kiln. For descriptive purposes, the longitudinal axis 44 of the kiln is considered as the x-axis. The upstream and downstream faces of the trefoil 20 are normal to the x-axis and, for purposes of this description, upstream face 46 is considered. The vertical centerline 48 of spoke 38 in the 12 o'clock position lies in the plane 46 and forms the y-axis. The horizontal radius 50 in face plane 46 at right angles to centerline 48 forms the z-axis 50. As will be seen from the description, infra the heat exchanger of this invention is formed from four or more elements, namely, the radial block or foot piece 52, the spoke block 54, the hub block 56, and the retention support blocks 58. All of the individual components are made from high temperature, ultra high-strength castable refractory. The recent availability of the material in this ultra high-strength form, enabled the heat exchanger of this disclosure. Further, for descriptive purposes, the elements are described as mounted within the structure. Thus, the upstream and downstream faces of the spoke blocks 54 lie in the yz planes - planes parallel to the one containing both the y-axis and the z-axis (see FIG. 2); the trefoil chamber faces of the spoke blocks 54 of the spokes 38 in the xy planes - planes parallel to the one containing both the x-axis and the y-axis; and, the faces of the spoke blocks 54 between adjacent blocks and normal to centerline 48 are in the xz planes - planes parallel to the one containing both the x-axis and the z-axis.

Figure 3:
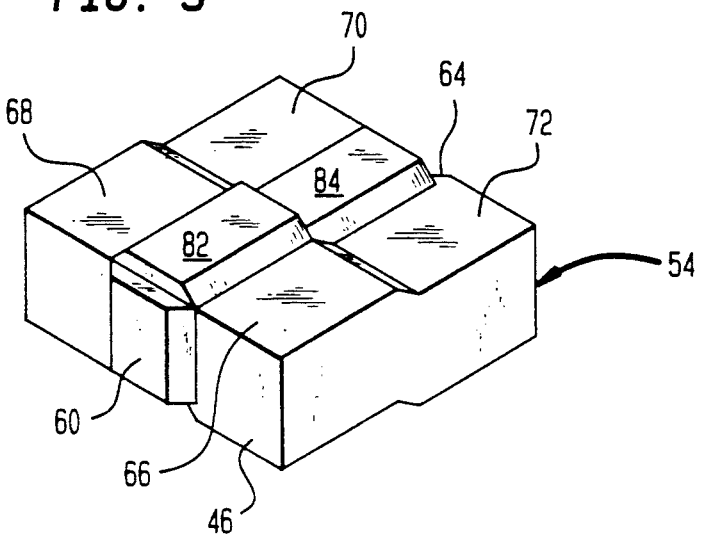
FIG. 3 is a rear perspective view taken from above of a spoke block.
Figure 4:
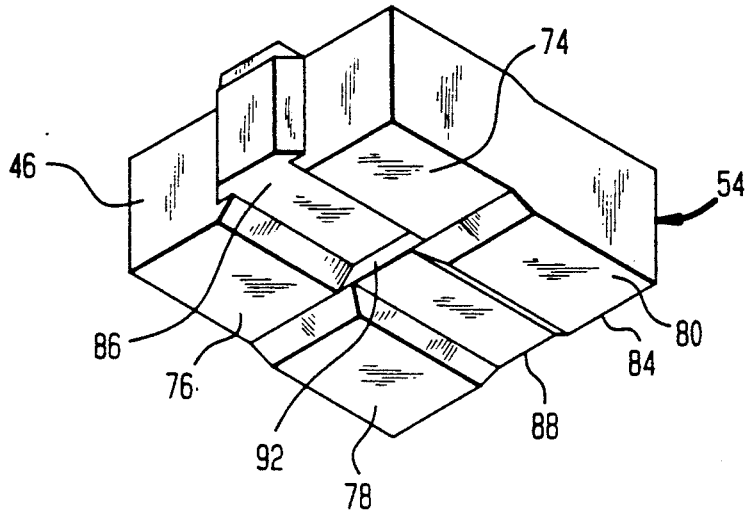
FIG. 4 is a rear perspective view taken from below of a spoke block, wherein the lower surface thereof interlocks with the upper surface of a spoke block as shown in FIG. 3.
Figure 6:
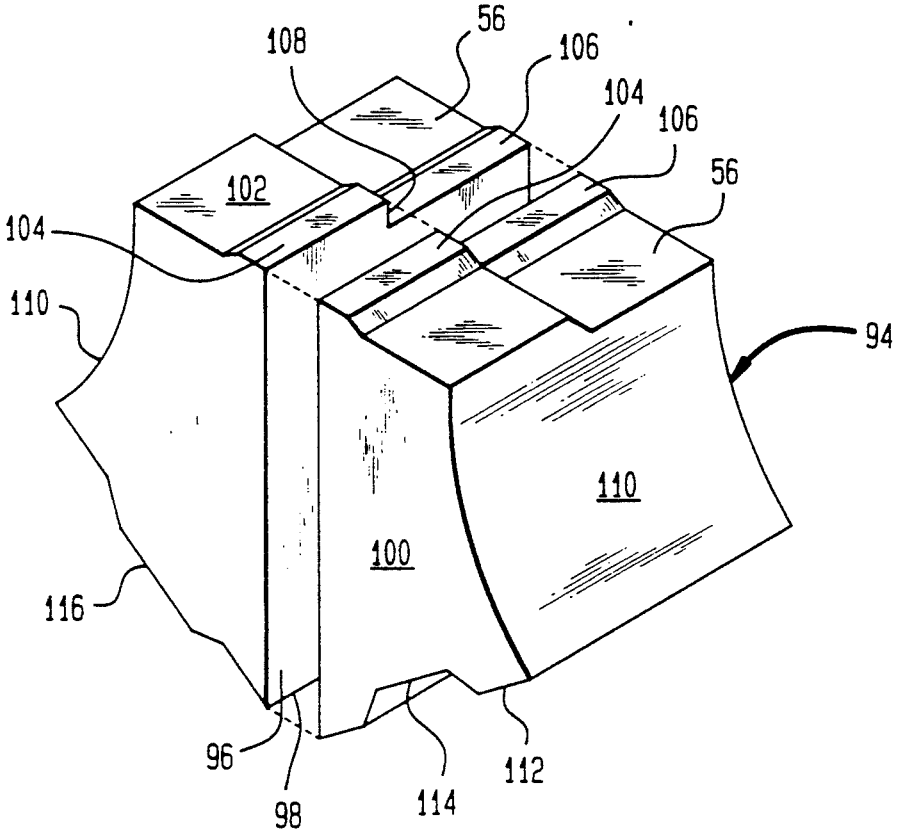
FIG. 6 is a rear perspective view taken from above of two mating hub block sections with the upper surface shown in corresponding relationship to the lower surface of FIG. 4.

With this frame of reference in place, the individual elements in FIGS. 3 through 7 are now discussed. The four block elements 52, 54, 56 and 58 represent a substantial, yet elegant, solution to many of the technological problems of trefoil construction. The four basic element approach is a systematic simplification of the prior art which either required expensive casting in place of all or part of the trefoil or complicated construction calling for numerous styles of bricks or blocks in combination, which trefoils frequently did not satisfactorily sustain the loading created by the kiln operating conditions. The specially precast blocks are all molded from ultra high-strength castable, refractory materials with exceptionally high hot modulus of rupture developed recently for operation in the 2,000° to 3,200° F. range. The spoke block 54 is first discussed in detail. To enhance understanding of the trefoil construction, FIG. 6 is juxtaposed above FIG. 3 as the lower surface of a set of radial blocks interlocks with the upper surface of a spoke block. Similarly, FIG. 4 is juxtaposed above FIG. 5 as the upper surface of a set of hub blocks interlocks with the lower surface of a spoke block. In reading the description of the spoke blocks shown in FIGS. 3 and 4, it should be noted that the lower surface shown in FIG. 4 interlocks with the upper surface shown in FIG. 3.

Figure 5:
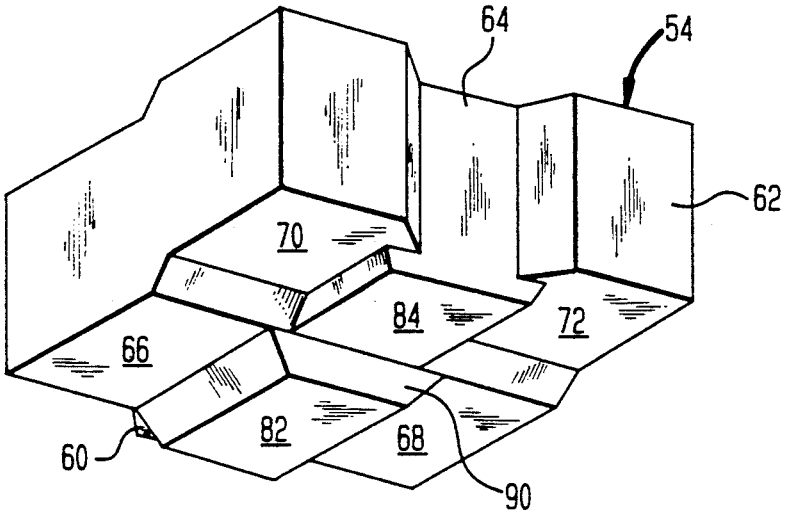
FIG. 5 is a front perspective view taken from below of a spoke block shown in FIG. 4.

Referring now to FIGS. 3, 4, and 5, the spoke block 54, the basic unit for the wall portions, is first discussed in detail. The position described is as though installed in a vertically disposed spoke wall 38. The upstream face 46 is disposed in a yz plane and is constructed with a projection 60 projecting along a line perpendicular to the x-axis 44 with a face in an xz plane. The downstream face 62 has an indention 64 for receiving a projecting portion 60 of another block 54 placed adjacent to and downstream of the block 54 being described. The upper surface, see FIG. 3, lying generally parallel to the x-axis in several xz planes has several sectors 66, 68, 70, and 72 being offset from one another which are constructed to function cooperatively with a correspondingly opposite lower surface sectors 74, 76, 78 and 80 thereof. The upper surface sectors 66 and 68 are constructed with projection 82 therebetween having a longitudinal axis parallel to the x-axis 44. The upper surface sectors 70 and 72 are constructed with a projection 84 therebetween for projecting into an indented portion of another block 54 placed atop the block 54 being described. The lower surface sectors 74 and 76 are constructed with an indention 86 therebetween corresponding to the upper surface projection 82. Similarly, lower surface sectors 78 and 80 are constructed with an indention 88 therebetween corresponding to upper surface projection 84. It is noted that a step or riser 90 is formed between projections 82 and 84 with a corresponding step or riser 92 between indentions 86 and 88. Riser 90 and riser 92 are coactive and are oriented to resist the kiln forces and to prevent travel of the trefoil in a downstream direction. The spoke block 54 is constructed by precasting from an ultra high-strength castable refractory, an exceptionally high hot modulus of rupture (per ASTM C-583). Such construction enables the trefoil structure 20 to resist compressive and torsional forces arising from deflections of the steel shell 24 during rotation , see supra and the downward pressure of the flowing product.

Referring now to FIGS. 4 and 6, the hub assembly 56 is next described in relation to the lower surface of spoke block 54. The hub assembly 94 is constructed from two hub segments or hub blocks 56. In the particular case at hand, the hub is formed from six segments each having a 60° arc. As is seen from FIG. 2, two adjacent hub blocks 56 of opposite hand serve each wall. The central plane of each spoke (an xy-plane for the vertically disposed spoke 38) is co-planar with interior surface 96, and, when installed, has the innermost edge 98 aligned with the longitudinal axis 44. The hub block 56 is described as though positioned for installation onto the vertically disposed spoke wall 38. The upstream face 100 is disposed in a yz plane and, when installed, is coplanar with upstream face 46 of spoke block 54. Opposite innermost edge 98 are two hub block faces—one configured and the other smooth. The configured face 102 has two projections 104 and 106, respectively, for interlocking with indentions 86 and 88, respectively. Hub block riser 108 is constructed to coact with spoke block riser 92. The smooth face 110 opposite innermost edge 98 has a projection 106 which mates with the trefoil chamber wall formed by the spoke blocks 54 and is best seen in FIG. 2. The smooth face 110 opposite innermost edge 98 is designed to be a smooth interconnecting curved portion between two adjacent heat exchanger chamber walls to facilitate the flow of the charge through the trefoil chamber. The interior face 112 is disposed between faces 96 and 110 and is optionally constructed with an indention 114 indenting along a line normal to the face 100. When hub block 56 is constructed with an indention 114, a corresponding projecting portion 116 is constructed on another hub block 56 placed adjacent the block 56 being described. The interconnecting relationship between hub blocks 56 and spoke blocks 54 is constructed to resist torsional forces resulting from the downhill flow of the charge during the rotation of the kiln. The hub block 56 is constructed by precasting from an ultra high-strength castable refractory having an exceptionally high hot modulus of rupture (per ASTM C-538) of least 3,000 psi@2,500° F. Such construction also enables the trefoil structure 20 to resist compressive forces arising from deflections of the steel shell 24, see supra.

Figure 7:
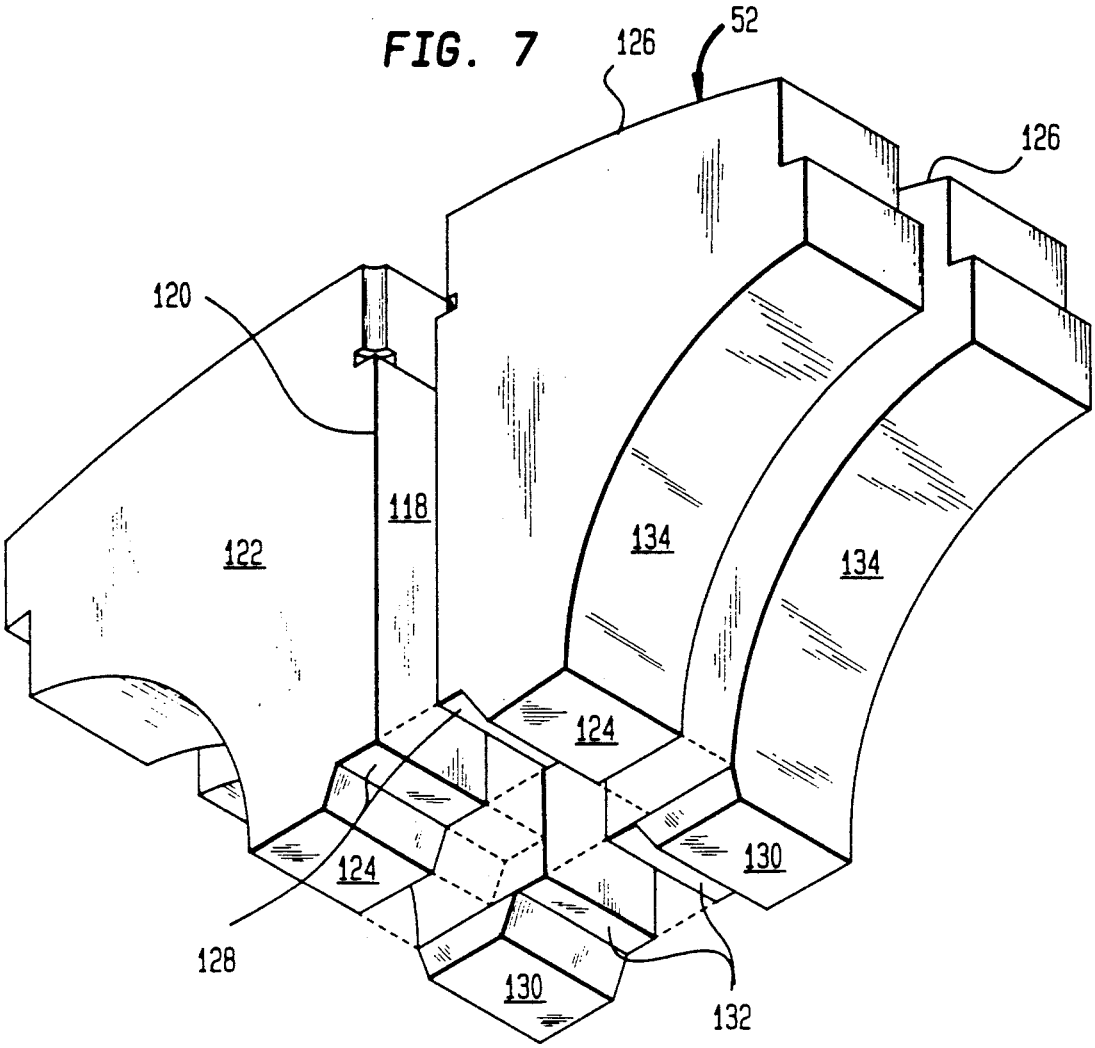
FIG. 7 is a rear perspective view taken from below of four mating radial block sections with the lower surface shown in corresponding relationship to the upper surface of FIG. 3.

Referring now to FIGS. 3 and 7 the radial block assembly 52 is next described. The radial block assembly, FIG. 7 is constructed from four segments each mating with a quadrant of the spoke block 54, FIG. 3. As is seen from FIG. 2, two adjacent radial blocks 52 of opposite hand serve the upstream portion of spoke block 54 and two adjacent radial blocks 52 of opposite hand serve the downstream portion of spoke block 54. The central plane of each spoke (an xy-plane for the vertically disposed spoke 38) is co-planar with interior surface 118 and, when installed, has the centerline of the spoke 38 (the y-axis) aligned with the interior edge 120 of surface 118. The radial block 52 is described as though positioned for installation onto the vertically disposed spoke wall 38. The upstream face 122 is disposed in a yz plane and, when installed, is coplanar with upstream face 46 of spoke block 54. The configured face 124 opposite the curved surface 126 (conforming to the steel shell 24 has an indention 128 for receiving a projecting portion 82 of block 54 placed in a mating relationship with the radial block 52 being described. The configured face 130 opposite the curved surface 126 has an indention 132 projecting along a line parallel to the x-axis for nesting within a corresponding projection 84 of a spoke block 54. Each of the mating surfaces 124 and 130 lying generally in a xz-plane has levels offset from one another which are constructed to function cooperatively with a correspondingly opposite spoke block upper surface sectors 66 and 68 (for surface 124) and sectors 70 and 72 (for offset surface 130). The interconnecting relationship between radial blocks 52 and spoke blocks 54 is constructed to resist torsional forces resulting from the downhill flow of the charge during the rotation of the kiln. The smooth curved face 134 adjacent configured faces 124 and 130 and the refractory bricks are designed to be a smooth interconnecting curved portion between the heat exchanger chamber walls and the standard shaped refractory brick lining to facilitate the flow of the charge through the trefoil chamber. The radial block 52 is constructed by precasting from an ultra high-strength castable refractory having an exceptionally high hot modulus of rupture (per ASTM C-583) of 3,000 psi@2,500° F. Such construction also enables the trefoil structure 20 to resist compressive forces arising from deflections of the steel shell 24, see supra.

Figure 9:
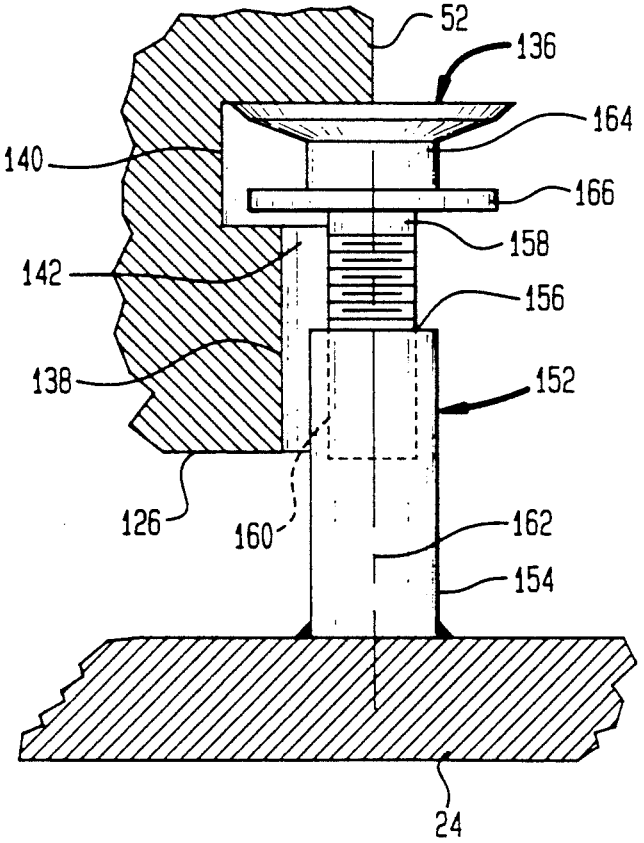
FIG. 9 is a detail view of the adjustable mounting assembly for mounting the radial block.
Figure 8:
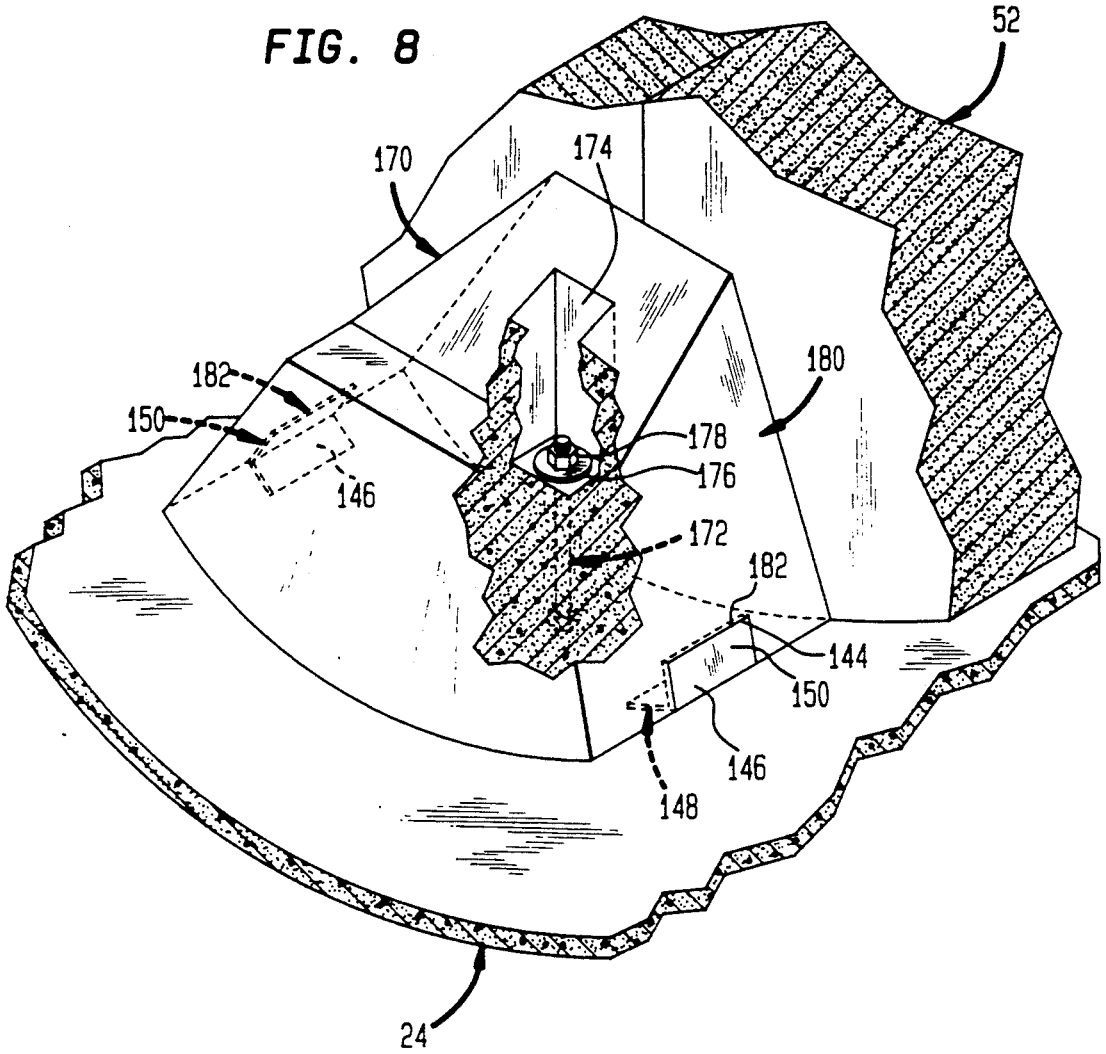
FIG. 8 is a perspective view of a retention support block.

Referring now to FIGS. 8 and 9, the retention support block 58 and the adjustable mounting assembly are shown. On the steel shell 24 side of the radial block 52 and along the curved surface 126, two provisions are made for tying the trefoil to the steel shell and for adjusting the relationship therebetween. First, adjacent the juncture of surface 126 and interior surface 118, the radial block 52 is constructed to accommodate the hold-down anchor bodies 136 within precast anchorways 138. The precast hold-down slots 140 for accommodating the hold-down bolt head, are described below. The anchorways 138 and slots 140 together form a receiving cavity 142 which is seen also in FIG. 9. Along the radially outward surface 138 adjacent curved surface 126, radially disposed slots 144 are constructed to accommodate flanged antispiralling plates or brackets 146. These L-shaped brackets 146 are constructed to have the sole portion 148 welded to the steel shell 24 in an axial alignment. The flange portion 150 then extends into slot 144. For purposes of this application, spiralling is defined as the radial shifting of a course of refractory brick or of a heat exchanger structure in relation to the adjacent upstream or downstream courses, such spiralling is frequently an indicia of kiln lining instability and deterioration. In the application at hand, each bracket 146 is positioned to span and stabilize, but shall not be limited to, two radial blocks 52.

Additionally, the trefoil leveling assembly 152 is constructed with a housing or saddle portion 154 which is affixed to the steel shell 24 and extends radially thereinto. The interior of housing 154 has a threaded aperture 156 therealong. A bolt 158 has a threaded end 160 for engagement with the aperture 156 and is constructed for adjustment inwardly and outwardly along the radius 162. A special bolt head 164 and washer 166 are constructed to engage slot 140 within the receiving cavity 138 of radial block 52. The retention support blocks 58 are manufactured from the same material as the trefoil or heat exchanger 20. The support block 170 is fastened to the shell 24 by a bolt 172 or bolts 172 whose heads are affixed welded to the shell 24. The support block 170 has a cavity 174 or cavities 174 to accept a washer 176 and a nut 178 to hold the support block 170 firmly to the shell and allow the nut 178 and washer 176 to be shielded from the direct heat of the process. The support block 170 is mounted upstream of retaining ring 34 and is mounted tightly against the downstream or front face of foot piece 52. This supports the foot pieces 52 and prevents from breaking. Also, this supports the trefoil 20 and prevents it from moving down the kiln because of the forces upon it. Along the radially outward surfaces 180 adjacent the bottom surface radially disposed slots 182 are constructed to accommodate flanges antispiralling plate or brackets 146. These L-shaped brackets 146 are constructed to have the sole portion 148 welded to the steel shell 24 in an axial alignment. The flange portion 150 then extends into slot 182 to prevent spiralling of this brick in this portion of the kiln.

The block arrangement described above provides a spoke block 54 with an offset profile. These are designed for stacks or piers of these blocks to form the spokes of the trefoil. It is within the contemplation of this invention that the spoke blocks 54 with minor design changes thereto be laid up in a lap bond arrangement or other bricklaying pattern so as to interconnect adjacent stacks of blocks axial along the walls.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed is:

1. A multichambered structure for a rotary kiln, said kiln having an inclined, cylindrical body mounted for rotation about the longitudinal axis thereof, said cylindrical body being a steel shell having a refractory brick lining therewithin, said kiln during rotation thereof receiving, at the upstream end for passage down the incline, a charge of materials-to-be-processed and, at the downstream end, heated gases for flowing countercurrent to said charge, said multichambered structure comprising, in combination:

at least three bases formed from radial blocks equidistantly spaced about and adjustably attached at one surface thereof to the inner surface of said steel shell, each said base extending axially along said steel shell and on the surface opposite the attachment having a profile therein for accepting spoke blocks;

at least three walls formed from spoke blocks, each of said walls extending radially from one of said bases and axially along the length of said base to the center portion of the cylindrical body, said spoke blocks having in one side thereof a profile complementary to said radial blocks for mating therewithin and having on the side opposite thereof a profile for accepting additional ones of said spoke bricks;

a hub assembly formed from hub segments interlocking with the spoke brick of the three walls and extending axially along the centralmost portion of the walls; and, each said spoke block, when viewing the exterior of said walls, having an offset profile and forming a wall resistant to torsional forces resulting from the flow of said charge during the rotation of the kiln.

2. A multichambered structure for a rotary kiln as described in claim 1 wherein said multichambered structure further comprises adjustment means for inserting between said steel shell and said radial blocks, said adjustment means adjusting for said deformations of said steel shell and resisting the compressive forces from said deformations.

3. A multichambered structure for a rotary kiln as described in claim 1 wherein said multichambered structure is a quatrefoil structure having four bases, each said base having a wall extending radially to the hub assembly.

4. A multichambered structure for a rotary kiln as described in claim 1 wherein said multichambered structure is a trefoil structure having three bases, each said base having a wall extending radially to the hub assembly, and wherein said profile of said radial block have recesses and said profile of said spoke blocks have corresponding projections and are in an interengaging static relationship precluding during rotation of the kiln movement of adjacent blocks along the axis of the kiln.

5. A multichambered structure for a rotary kiln as described in claim 1 wherein said multichambered structure is a further defined as having a longitudinal axis, the x-axis, coaxial with said cylindrical body; a plane normal thereto in which lies the upstream face of said multichambered structure having a substantially vertical line therein, the y-axis, intersecting said longitudinal axis; and a substantially horizontal line therein, the z-axis, intersecting said longitudinal axis and wherein said deformations of said steel shell exert compressive forces on the multichambered structure along the y-axis and are resisted by projections extending normal thereto in along both the x-axis and the z-axis.

6. A multichambered structure for a rotary kiln as described in claim 5 wherein torsional forces resulting from the flow of said charge during the rotation of the kiln exert a net force on the multichambered structure along the x-axis, said net force resisted by projections extending normal thereto along both the y-axis and the z-axis.

7. A multichambered structure for a rotary kiln as described in claim 5 wherein torsional forces resulting from the flow of said charge during the rotation of the kiln exert a net force on the multichambered structure along the x-axis, said net force resisted by the offset profile of the spoke block deflecting components of said forces normal thereto along both the y-axis and the z-axis.

8. A multichambered structure for a rotary kiln as described in claim 1 wherein said adjustment means comprises:

a saddle affixed to said steel shell;

a threaded aperture therethrough extending radially with respect to said cylindrical body;

a bolt with a threaded end and a bolt head, said threaded end threadingly engaging said threaded aperture and adjustable inwardly and outwardly along a radius of the cylindrical body; and, a receiving cavity in said radial block to accept the bolt head and to adjust the radial positioning thereof.

9. A heat exchanger structure for a rotary kiln, said kiln having a cylindrical body on an incline with one end higher than the other and mounted for rotation about the longitudinal axis thereof, said cylindrical body having a steel shell and a refractory brick lining therewithin, said kiln receiving during rotation thereof at the higher end for passage down the incline a charge of materials-to-be-processed and at the lower end heated gases for countercurrent flow against said charge, said heat exchanger structure defined as having a longitudinal axis coaxial with that of said cylindrical body, the x-axis, a plane normal thereto in which lies the upstream face of said trefoil structure having a substantially vertical line therein, the y-axis, intersecting said longitudinal axis, and a substantially horizontal line therein, the z-axis, intersecting said longitudinal axis, said heat exchanger structure comprising, in combination:

three or more bases formed from radial blocks of castable refractory material equidistantly spaced about and adjustably attached at one surface thereof to the inner surface of said steel shell, each said base extending axially along said steel shell and on the surface opposite the attachment having a profile therein for accepting spoke blocks;

three or more walls formed from spoke blocks of castable refractory material, each of said walls extending radially from one of said bases and axially along the length of said base to the center portion of the cylindrical body, said spoke blocks having in one side thereof a profile complementary to said radial blocks for mating therewithin and having on the side opposite thereof a profile for accepting additional ones of said spoke blocks, said spoke blocks interlocking in the direction of the x-axis and emplaceable in a lap bond arrangement;

a hub assembly formed from hub segments of castable refractory material interlocking with the spoke block of the walls and extending axially along the centralmost portion of the walls;

each said spoke block, when viewing the exterior of said walls, having an offset profile and forming a wall resistant to forces exerted parallel to the x-axis resulting from the flow of said charge during the rotation of the kiln; and, adjustment means for inserting between said steel shell and said radial blocks, said adjustment means adjusting for said deformations of said steel shell and providing resistance to forces exerted parallel to the y-axis and z-axis resulting from said deformations.

10. A trefoil structure for a rotary kiln as described in claim 9 wherein said profile of said radial block have recesses and said profile of said spoke blocks have corresponding projections and are in an interengaging static relationship.

11. A trefoil structure for a rotary kiln as described in claim 9 wherein said deflections of said steel shell exert compressive forces on the trefoil structure along the y and z-axis and are further resisted by projections extending substantially normal thereto along both the x-axis and the z-axis.

12. A trefoil structure for a rotary kiln as described in claim 11 wherein torsional forces resulting from the flow of said charge during the rotation of the kiln exert a net force on the trefoil structure along the x-axis, said net force resisted by projections extending normal thereto along both the y-axis and the z-axis.

13. A trefoil structure for a rotary kiln as described in claim 9 wherein said adjustment means comprises:

a saddle affixed to said steel shell;

a threaded aperture therethrough extending radially with respect to said cylindrical body;

a bolt with a threaded end and a bolt head, said threaded end threadingly engaging said threaded aperture and adjustably movable inwardly and outwardly along a radius of the cylindrical body; and, a receiving cavity in said radial block dimensioned to accept the bolt head for adjusting the position of the radial block.

14. A trefoil structure for a rotary kiln as described in claim 9 wherein said structure further comprises:

a retaining ring mounted about the interior of the steel shell downstream of the trefoil structure holding said refractory bricks against forces exerted along the x-axis.

15. A trefoil structure for a rotary kiln as described in claim 9 wherein said structure further comprises:

a plurality of support retention blocks mounted on the interior of the steel shell and abutting downstream face of the radial block;

a plurality of flanged plates mounted on the interior of the steel shell and abutting the exterior of the radial block, said flanged plates holding the heat exchanger structure against spiralling in response to forces in both the y- and z-axis and combinations thereof.

16. A trefoil structure for a rotary kiln, said kiln having a cylindrical body on an incline with one end higher than the other and mounted for rotation about the longitudinal axis thereof, said cylindrical body having a steel shell and a refractory brick lining therewithin, said kiln receiving at the higher end for passage down the incline a charge of materials-to-be-processed and at the lower end heated gases for countercurrent flow against said charge, said trefoil structure comprising, in combination:

a plurality of radial blocks of castable refractory material forming three or more bases equidistantly spaced about and adjustably attached at one surface thereof to the inner surface of said steel shell, each said base extending axially along said steel shell and on the surface opposite the attachment having a profile therein for accepting spoke blocks;

a plurality of spoke blocks of castable refractory material forming three trefoil walls, each of said walls extending radially from one of said bases and axially along the length of said base to the center portion of the cylindrical body, said spoke blocks having in one side thereof a profile complementary to said radial blocks for mating therewithin and having on the side opposite thereof a profile for accepting additional ones of said spoke blocks, said spoke blocks emplaceable in a lap bond arrangement and interlocking in the direction of the longitudinal axis of the kiln;

a plurality of hub segments of castable refractory material interlocking with one another and with the spoke blocks of the walls to form an interlocked hub extending axially along and joining the centralmost portion of the walls;

each said spoke block, when viewing the exterior of said walls, having an offset profile and forming a wall resistant to forces exerted parallel to the longitudinal axis resulting from the flow of said charge during the rotation of the kiln;

adjustment means for inserting between said steel shell and said radial blocks, said adjustment means adjusting for said deflections of said steel shell and resisting forces exerted normal to the longitudinal axis resulting from said deflections; and, a retaining ring mounted about the interior of the steel shell downstream of the trefoil structure maintaining the positioning of the refractory bricks against forces exerted during kiln operation.

17. A trefoil structure for a rotary kiln as described in claim 16 wherein said adjustment means comprises:

a saddle affixed to said steel shell;

a threaded aperture therethrough extending radially with respect to said cylindrical body;

a bolt with a threaded end and an enlarged bolt head, said threaded end threadingly engaging said threaded aperture and adjustable inwardly and outwardly along a radius of the cylindrical body; and, a receiving cavity in said radial block to accept the bolt head and to adjust the radial positioning thereof.

18. A heat exchanger structure for a rotary kiln as described in claim 16 wherein said structure further comprises:

a plurality of flanged plates mounted on the interior of the steel shell and abutting the exterior of the radial block, said flanged plates holding the heat exchanger structure against spiralling in response to kiln operating forces.

19. A heat exchanger structure for a rotary kiln as described in claim 16 wherein said radial blocks and said hub blocks are configured with smoothly curved interior junctures between sides of the chambers of the heat exchanger.

20. A heat exchanger structure for a rotary kiln as described in claim 19 wherein said structure further comprises:

a plurality of projections on along the upstream edge of each wall facilitating the dividing of the charge into the three chambers of the heat exchanger.

* * * * *